US005295787A

United States Patent [19]

Leonard et al.

[11] Patent Number: 5,295,787

[45] Date of Patent: Mar. 22, 1994

[54] TURBINE ENGINES

[75] Inventors: John F. Leonard, Bristol; Peter J. Maggs, Bath, both of England

[73] Assignee: Rolls-Royce plc, London, England

[21] Appl. No.: 955,026

[22] Filed: Oct. 1, 1992

[30] Foreign Application Priority Data

Oct. 9, 1991 [GB] United Kingdom ..... 9121386

[51] Int. Cl.[5] ..... F01D 5/20

[52] U.S. Cl. ..... 415/173.3; 415/134; 415/136

[58] Field of Search ..... 415/134, 135, 136, 137, 415/173.1, 173.3, 138, 139

[56] References Cited

U.S. PATENT DOCUMENTS

| | | | |
|---|---|---|---|
| 4,696,619 | 9/1987 | Lardellier | 415/138 |
| 4,804,310 | 3/1989 | Fuller et al. | 415/134 |
| 4,863,345 | 9/1989 | Thompson et al. | 415/134 |
| 5,100,291 | 3/1992 | Glover | 415/135 |
| 5,137,421 | 8/1992 | Hayton | 415/173.3 |
| 5,145,316 | 9/1992 | Birch | 415/173.3 |
| 5,178,514 | 1/1993 | Damiral | 415/139 |
| 5,192,185 | 3/1993 | Leonard | 415/173.3 |
| 5,211,534 | 5/1993 | Catlow | 415/173.1 |
| 5,228,828 | 6/1993 | Damlis et al. | 415/173.3 |

FOREIGN PATENT DOCUMENTS

| | | | |
|---|---|---|---|
| 1326037 | 3/1963 | France | 415/139 |
| WO79/01008 | 11/1979 | PCT Int'l Appl. . | |
| 1451901 | 10/1976 | United Kingdom . | |
| 1484936 | 9/1977 | United Kingdom . | |
| 2206651 | 1/1989 | United Kingdom . | |
| 2061396 | 5/1991 | United Kingdom . | |

*Primary Examiner*—John T. Kwon
*Attorney, Agent, or Firm*—Oliff & Berridge

[57] ABSTRACT

A gas turbine engine having a main casing, turbine blades and a segmented cylindrical liner surrounding the tips of the blades is provided with apparatus for compensating for different radial expansions between the blades and the liner. The apparatus comprises a shroud structure, such as a platform of an axially adjacent nozzle guide vane, and a slipper element extending radially from the shroud structure to the liner and coupling one to the other. The slipper element expands circumferentially more slowly than does the shroud structure. Thermal circumferential growth of the shroud structure causes a radial displacement of the liner segments relative to the shroud structure.

15 Claims, 5 Drawing Sheets

A
B
C
D
222
230
232
234
236
238
240
242
244
246
248
250
252
254
258
262
264
266
268
274
276
278
298
308
310
312
316
318
320
322

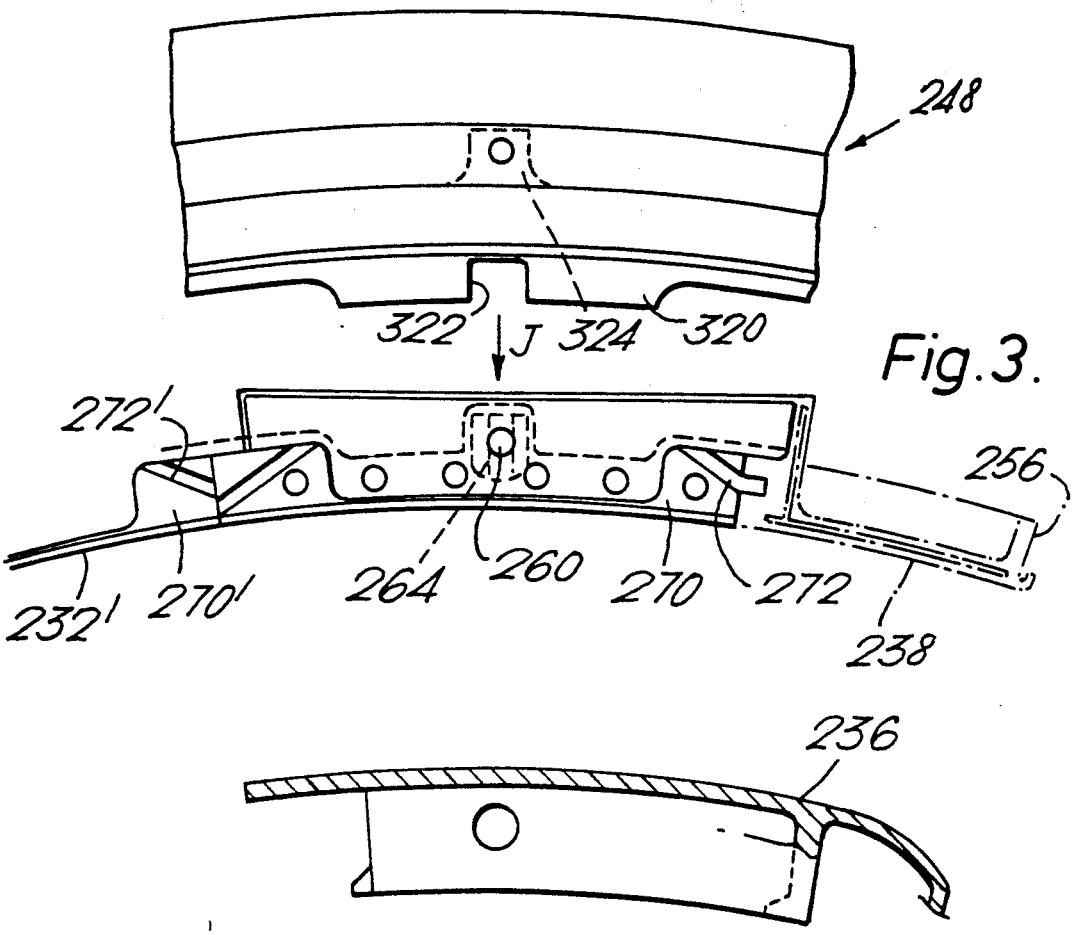
Fig.3.
Fig.3a.
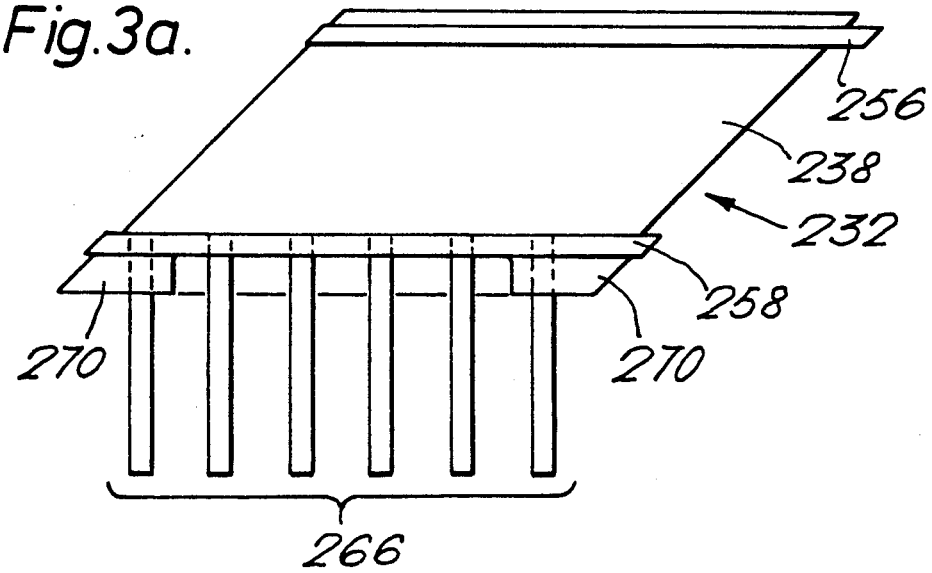

286
284
282
280
274
294
292
288
268
296
250
290
G
H
E
278
306
240
F
326
312
314
324
248

TURBINE ENGINES

This invention relates to gas turbine engines, and in particular to the manner in which liner parts of the turbine, surrounding the turbine blade tips, are mounted and adjusted.

It is known to compensate in a gas turbine engine for the differing thermal expansion behaviour governing the relative positions of the turbine blade tips and the surrounding shroud liner at different stages of use. The clearance between the rotor blade tips and the liner has a strong effect upon turbine efficiency (specific fuel consumption) and ideally should be kept as small as possible at all times.

In the past, measures have been proposed to match the final steady-state degree of expansion of the liner to correspond with that of the related rotor, giving a small tip clearance. These proposals did not take account of differing rates of expansion in non-steady-state operation, caused by the different structural shapes of the parts. Consequently blade tip clearance was not optimally matched. The general tendency is for the liner or casing to respond thermally more rapidly than the rotor construction, so that means must be provided to delay the liner response if an undesirably large steady-state tip clearance is to be avoided.

The present applicant's British patent application 2061396 proposes a more sophisticated construction, which seeks to match the thermal growth rates of the rotor disc and liner by coupling the liner segments to the inlet guide vane outer platforms, and coupling the inlet guide vanes (which like the rotor blades expand rapidly) to an insulated disc which mimics the slower expansion properties of the more bulky rotor disc. The movable shroud liner segments are supported between the outer platforms of upstream and downstream guide vanes.

A disadvantage of this prior proposal is that it takes no account of the rapid centrifugal growth of the rotor assembly which takes place on acceleration. The guide vanes of course do not grow in this manner, nor does the insulated "dummy" rotor disc, because they do not rotate. Consequently it is necessary to accept a larger tip clearance when cold, and hence less efficiency when operating away from the final steady state condition.

Analysis of the tip-liner clearance over a run cycle reveals that in fact the smallest clearance occurs not when running steadily at high speed, but rather at a transient condition occurring shortly after reaching full power.

It would be desirable to provide new means for governing blade tip-liner clearance, and preferably so as to enable a generally reduced clearance over the run cycle and hence greater efficiency.

According to a first aspect of the invention, in a gas turbine engine, segments of a hollow cylindrical liner or shroud which surrounds the tips of turbine blades are coupled to an axially adjacent shroud structure in such a manner that thermal circumferential growth of that adjacent structure drives a radial displacement of the liner segments relative to that adjacent structure.

The axially adjacent shroud structure may be an outer platform of a nozzle guide vane.

The coupling may be achieved by coupling a liner segment to the adjacent structure by means of a slipper which expands circumferentially in operation more slowly than the adjacent structure, for example by virtue of being positioned radially outwardly thereof and thus being shielded from the hot gas flow.

Such a difference in circumferential thermal expansion rate between the slipper and adjacent structure may then be converted to a relative radial displacement by having these parts engaged by way of a slipping interface between the parts along which the engaging portion of one of the parts can ride when the differential circumferential expansion occurs, and which is inclined to the tangential direction. One or more dogs on one part, preferably the slipper, with inclined slipping surfaces engaging complementary inclined surfaces of recesses on the other part, are suitable ways of achieving this.

The novel technique described above enables a special advantage to be achieved. Initially, the slower expansion of the slipper element causes it and the coupled liner segment to be driven radially outwardly. Once the adjacent structure has fully expanded, the slipper will continue to expand at its slower rate so that it is then expanding relative to the adjacent structure, for instance the guide vane platform. The movement is thus then reversed so that the slipper and liner segment move relatively radially inwardly again. Overall, the effect is a temporary radial retraction of the liner segment relative to the adjacent structure, for instance the guide vane outer platform.

This temporary radial retraction can correspond to the transient phase described above which would normally involve the minimum tip-liner clearance. The tip clearance at other conditions can therefore be reduced without fear of rubbing at the transient condition, because the liner segments are then temporarily retracted. Greater efficiency may then follow, with particular benefit at steady-state conditions.

Generally each liner segment will have a respective slipper. The slippers may be substantially separate from the liner segments themselves, fixed to them in a way which allows the liner segment to expand freely in a circumferential direction, without conflicting with the expansion of the slipper.

A slipper element may have a generally L-section comprising a radially outwardly extending limb by which it can be supported in the main casing, and which may carry the driving dogs or the like to engage the adjacent structure at that end, and an axially-extending limb with means for securing the liner segments.

In a turbine construction having shroud liner segments that are radially movable, there is a problem associated with supporting the segments stably in the assembly so that the desired radial movement is not accompanied by undesirable movements such as tilting. British patent application 2061396, already mentioned above, has the liner segments supported at both axial extremities by trapping in circumferential grooves of the neighbouring outer guide vane platforms. This has disadvantages in that removal of the rotor assembly entails removal not only of a set of guide vanes but also of all the liner segments supported thereby. Furthermore, particular problems arise with a construction for instance as in the first aspect described above, in which the liner segments around the blade tips are radially movable relative to the axially adjacent liner structure. Different support means are then needed, particularly where the radial drive is situated—as is usually most desirable—at or towards an axial extremity of the movable liner segment. Unless the segments are driven from both ends, which is undesirably complicated, this raises the possibility of a couple being exerted by the driving force and the general pressure on the liner segment, tending to tilt the latter.

In a second aspect of the invention, therefore, a radially movable shroud liner segment is supported through a radially extending carrier part integral therewith, or secured thereto, and which may be a slipper element as described for the first aspect. A main support engages the carrier part from one axial side thereof at radially spaced locations so as to be able to support a couple. The support engages the carrier with a first, compression-bearing engagement at a first engagement location, and at a second engagement location with a second, tension-bearing part of the support which is radially flexible so that it can deflect at the second engagement location to follow the radial displacement of the shroud liner segment relative to the support.

The compression-bearing part of the support may by contrast make a sliding engagement against the carrier at the first location.

The support desirably has an annular construction extending around the turbine so as to support all of the set of movable segments.

The construction described can provide new advantages. Firstly, the support supports the carrier and liner segments from one axial side, by using compressive and tensile connections to counter a couple instead of spaced compressive engagements acting in opposing axial directions. This enables the support and liner to be assembled as a module and, if desired, the liner machined in situ to avoid a number of dimensional and concentricity tolerances. Also, the construction does not rely on support on both sides from adjacent shroud structures, so assembly and disassembly are facilitated. Secondly, the flexible tensile element of the support can support the carrier movably without frictional resistance. The only friction need be at the compressive engagement. Effectively this may halve frictional resistance to radial movement of the liner segment, which may be crucial e.g. when a slipper is used, and the liner must follow the driving engagement under the urge of cooling gas pressure alone. So, the construction is particularly effective used in combination with the first aspect described above.

The carrier part may be a radial flange at or towards one axial extremity of the liner segment. Usually it will be on the upstream side.

The support preferably engages the carrier part from the downstream side.

The tensile part of the support preferably comprises an axially-extending flexible finger extending from a body of the support, and adapted to be fixed at its free end to the carrier.

The compression part of the support is preferably a continuous wall extending axially and butting against the carrier. For an annular support body, the continuous wall may be a generally cylindrical wall extending around it to serve all segments The preferred form of the support is an annulus with a rectangular cross-section, the outer side of the rectangle being the cylindrical wall for compressive engagement, the inner side being provided intermittently by tensile flexible fingers, one axial end being open and against the carrier, and the other end being parallel to the carrier surface and forming a body to connect the inner and outer parts solidly together An embodiment of the invention will now be described by way of example only with reference to the accompanying drawings, in which:

FIG. 2(*a*) is a view on the line "D—D" of FIG. 2;

FIG. 2(*b*) is a fragmentary section circumferentially displaced from FIG. 2, showing cooling tubes at the shroud liner;

FIG. 2(*c*) is a view on arrow "C" of FIG. 2;

FIG. 3 is a view on arrow "A" of FIG. 2, showing the nozzle guide vane and platform unit, and the manner of fitting of a thrust cone;

FIG. 3(*a*) is a view on arrow "J" of FIG. 3, showing the nozzle guide vane platform and its associated cooling tubes;

Figures 4, 4A, 4B, 5A, 5B:
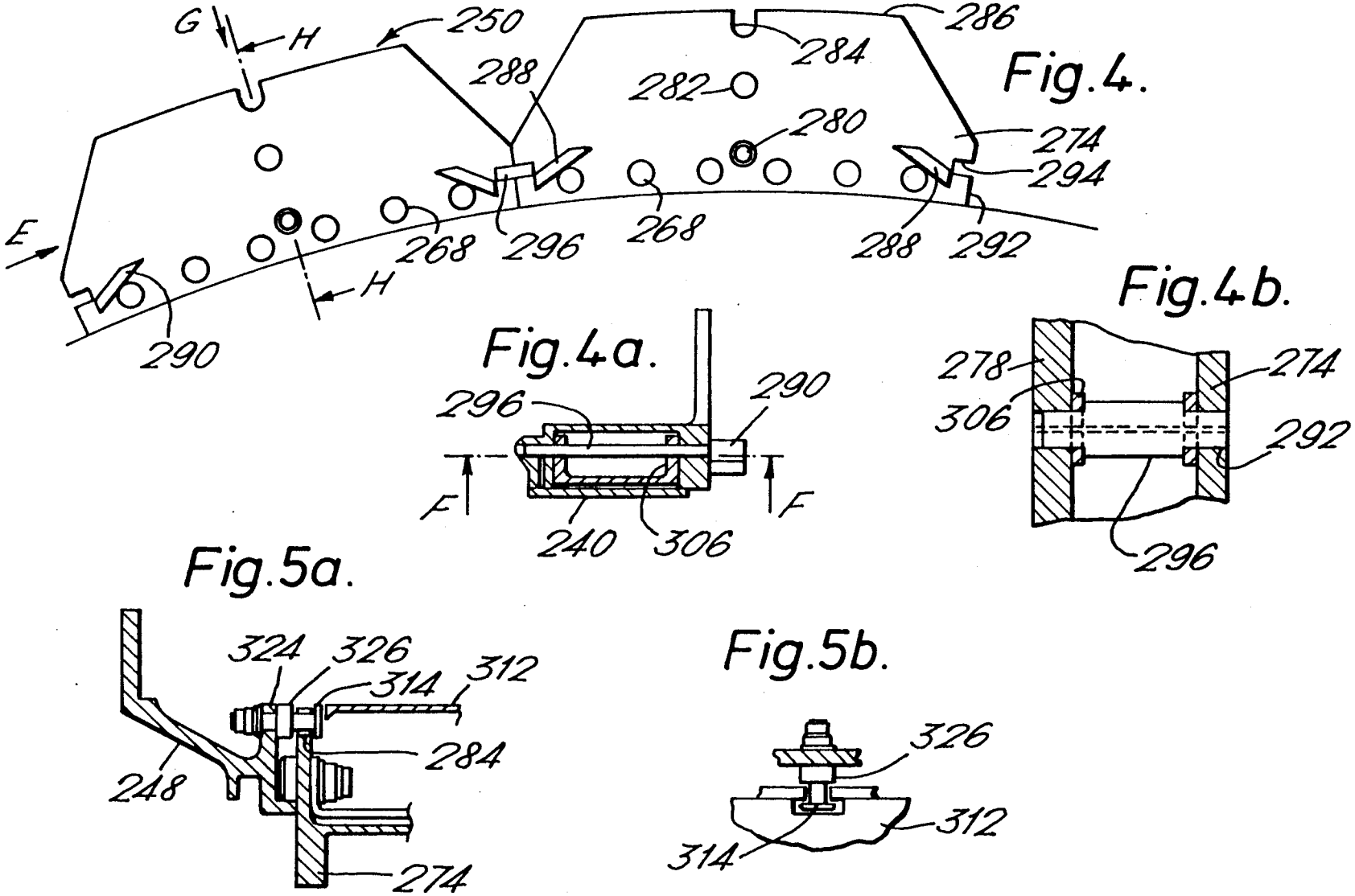
FIG. 4 shows two slipper elements from upstream (arrow "B" in FIG. 2)
Figure 6:
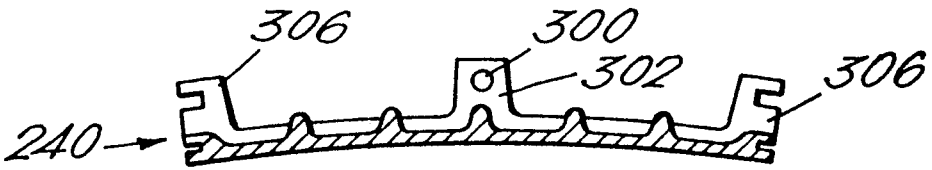
Figure 7:
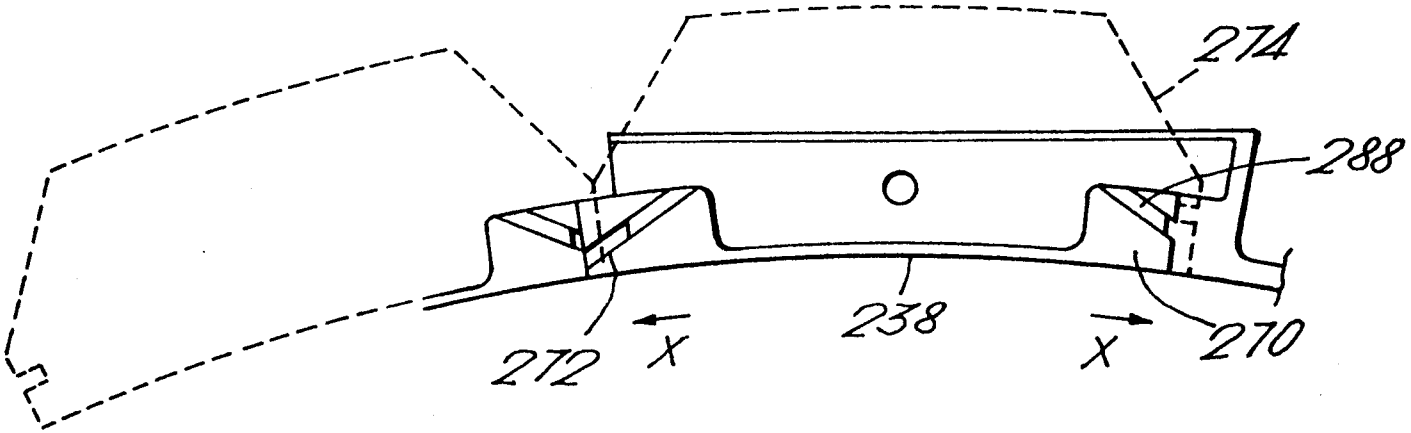

FIGS. 4(*a*) and 4(*b*) are a view on arrow "E" of FIG. 4 and a top view thereof, showing end connections between adjacent slippers;

FIG. 5(*a*) is a section at "H—H" in FIG. 4, showing connections of a thrust cone behind the slipper, and FIG. 5(*b*) is a radially inward view (along "G") of the connection;

FIG. 6 is a circumferential section of a shroud liner segment; and,

FIG. 7 shows diagrammatically, from an axial point of view, the wedging engagement between the slippers and the nozzle guide vane platforms.

Figure 1:
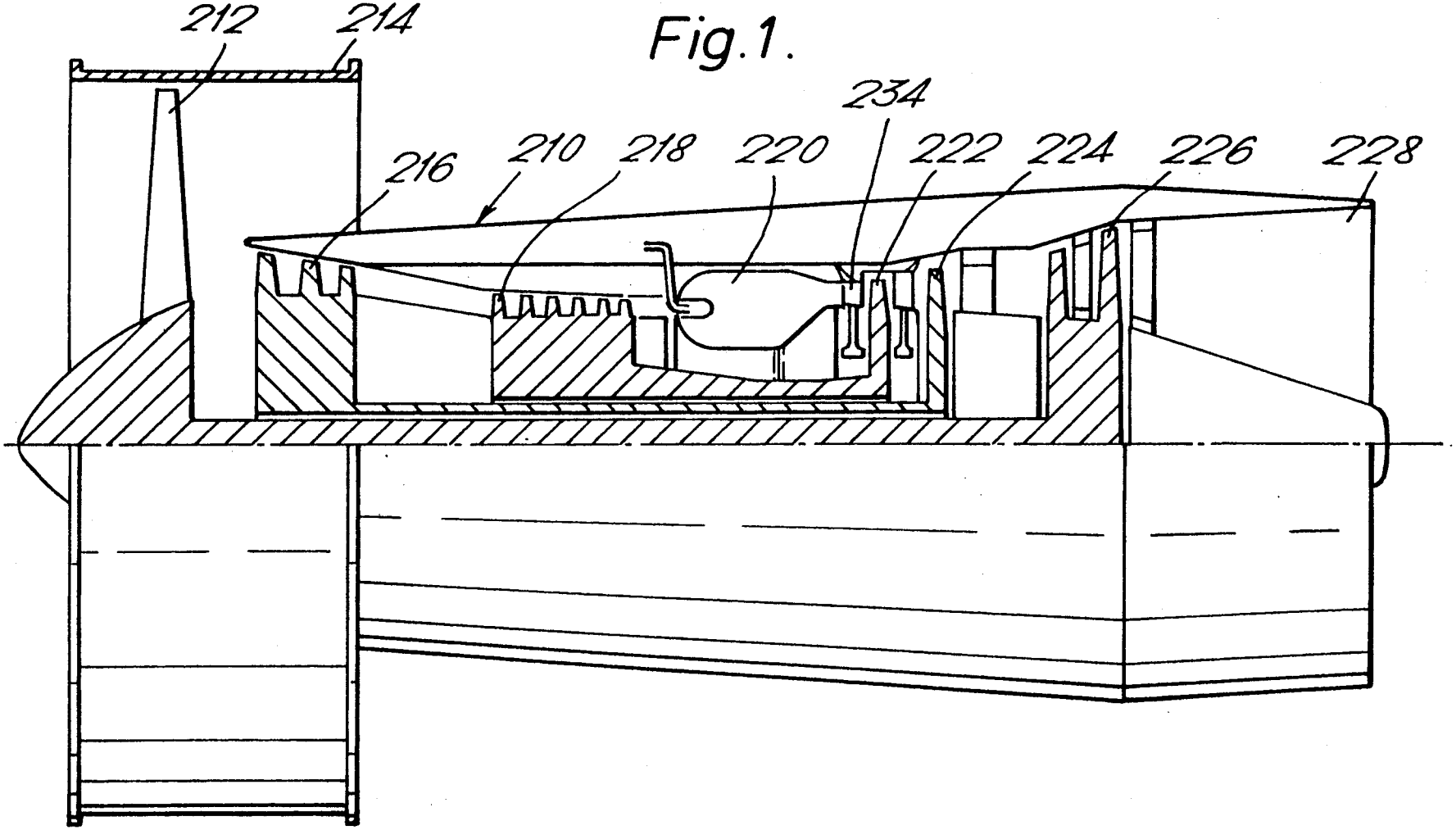
FIG. 1 is a schematic part-section showing a general arrangement of a gas-turbine aero engine.

FIG. 1 shows a gas turbine engine 210 of the bypass type. A general arrangement is shown and comprises, in flow series, a low pressure compressor and bypass fan 212 mounted in a bypass duct 214, a multi-stage intermediate pressure axial flow compressor 216, a high pressure axial compressor 218, a combustion chamber 220, a high pressure turbine 222, an intermediate pressure turbine 224, a low pressure turbine 226 and a jet pipe 228. These features are all conventional. Other types of turbine engine are known, and the present invention can also be applicable to them.

The invention is particularly concerned with the construction around the periphery of the turbines, especially the high pressure turbine 222. A more detailed and enlarged view, in axial section at the periphery of the high pressure turbine, is shown in FIG. 2.

Figures 2, 2A, 2B, 2C:
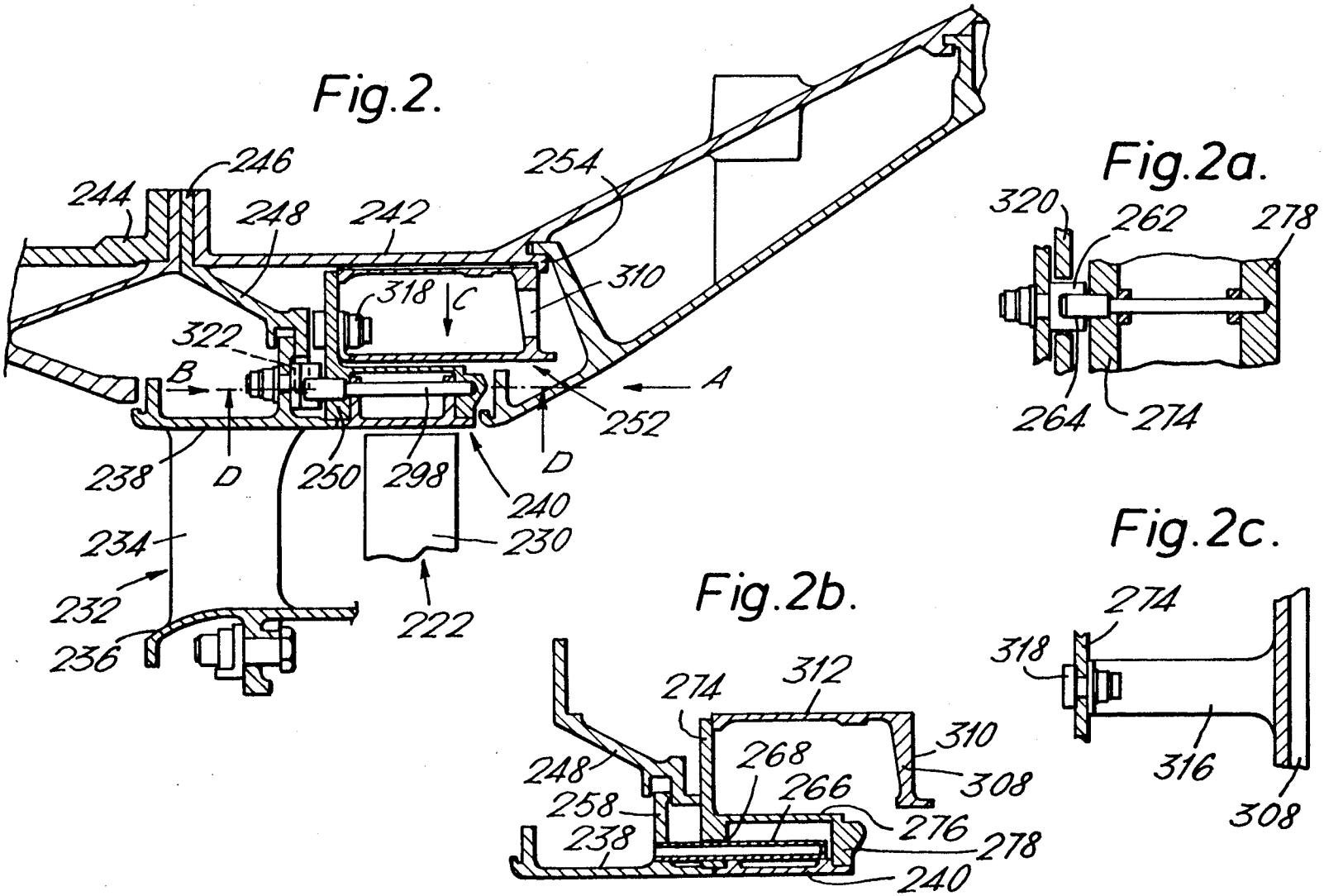
FIG. 2 is a general section in the vicinity of a nozzle guide vane and shroud liner of a high pressure turbine stage of the engine.

FIG. 2 shows the extreme end of one of the turbine blades 230. This is on a turbine rotor assembly which is of conventional type (and therefore not shown) comprising an annular central turbine disc with a relatively massive central hub, and a plurality of equally spaced turbine blades 230. The high pressure turbine is secured to an axial shaft to drive the high pressure compressor 218.

On the upstream side of the turbine blade 230 i.e. on the left in FIG. 2, is shown a nozzle guide vane ("NGV") segment 232 which is one of a plurality of such segments arranged circumferentially around the turbine upstream of the blades, to guide flow in a known manner. Each NGV segment 232 comprises a radially-extending guide vane 234 fixed between an inner platform 236 and an outer platform or tip shroud 238. The outer platforms 238 of the array of NGV segments 232 form an axial part of the tubular cylindrical conduit through which the hot gases flow to the turbine blades.

Downstream of the NGV segments, in radial register with their outer platforms 238 and in axial register with the turbine blade 230, is a circumferential array of shroud liner segments 240. The radially inward shroud liner surfaces of these combine to form a cylindrical shroud liner portion surrounding the turbine blades and spaced from their tips by a small clearance. These features as such are conventional.

Downstream of the shroud liner segments 240, the interior of the main casing 242 flares outwardly to a larger cross-section downstream. This may be for example an inlet to a further turbine Upstream of the main casing element 242 shown, a further outer casing element 244 is shown. This butts against the main casing 242 and clamps between the butted parts an outer securing flange 246 of a thrust cone 248 which tapers inwardly in the downstream direction inside the casing space. The downstream end of thrust cone 248 makes a number of locating engagements with other elements in the assembly; these will be described later.

The liner segments 240 are secured to respective slipper elements or slippers 250 which are generally L-shaped in axial cross-section; as will be described in detail later, these serve as carriers via which the liner segments 240 can be driven radially, and also supported in their correct alignment in the assembly. The slipper elements 250 are engaged on the upstream side by a driving connection with the outer parts of the NGV segments 232, and on the downstream side by support engagements with an annular support 252.

Annular support 252 extends circumferentially around the turbine just outside the liner segments 240 and the axial limb of the slippers 250. At its outer downstream edge, it butts against a locating flange or casing shoulder 254 of the casing 242, which projects in and locates the annular support 252 axially. Annular support 252 has a generally open rectangular cross-section. Its basic function is to hold the slippers 250 and liner segments 240 in position; the exact manner in which it does so is described later.

The NGV segments 232 are now described in more detail with reference to FIGS. 2 and 3. The outer platform 238 of each segment 232 is a generally lozenge-shaped curved plate in which the upstream and downstream edges extend circumferentially. Projecting radially outwardly from the platform 238 are an upstream circumferential flange 256 and downstream, adjacent the downstream edge, a taller downstream circumferential flange 258.

Downstream flange 258 is provided with a central bolt-hole 260 through which passes a bolt to fix on the downstream side of downstream flange 258 a body 262 provided with a radially extending guide channel 264.

A circumferential series of axially-extending cooling tubes 266 are seated through respective holes spaced along the downstream flange 258. Cooling tubes 266 extend axially downstream through oversize clearance holes 268 in the slipper elements 250 (see FIG. 4) and over the main extent of the liner segment 240, which they serve to cool in operation.

At the circumferential extremities of its downstream face, the downstream flange 258 comprises integral driving blocks 270. Each driving block 270 has a driving slot 272. The driving slots 272 are straight, axially-recessed, and inclined upwardly from the tangential direction at about 30° towards the centre of the downstream flange 258. They are of uniform width and have smooth inner surfaces. As seen in FIG. 3, the neighbouring NGV segment 232' has a corresponding block 270' and slot 272'.

The slippers 250 are now described in more detail with reference to FIGS. 2, 4, 4(*a*) and (*b*) and FIG. 7 in particular. Each slipper element 250 is a one-piece casting comprising a flat radial plate 274 extending circumferentially and an axial plate 276 which extends perpendicularly downstream from plate 274, forming the second limb of the "L". At its downstream end, axial plate 276 has a radially in-turned securing flange 278 which has a cylinder segment inner peripheral edge in register with that of the main radial plate 274.

Spaced along its radial mid-line, each slipper element 250 has a liner-retaining pin hole 280, a support bolt hole 282 spaced outwardly thereof, and an outwardly facing notch 284 at a radially outer edge 286 of the slipper 250, as shown in FIG. 4. The clearance holes 268 for the cooling tubes 266 are provided along the inner periphery, as has been described.

Extending integrally from the upstream face of the radial plate 274, and the circumferential extremities thereof, are two driving dogs 288. These dogs 288 are flat and are of a size and angle to fit neatly into the slanting slots 272 in the driving blocks 270 of the NGV segment 232. This engagement is shown schematically in FIG. 7. Sloping surfaces 290 of the dogs 288 can slide against the corresponding surfaces of the slots 272 when differential thermal expansion takes place. At their circumferential extremity 292, the radial plates 274 have notches 294 into which fit locating pieces 296, as seen in FIGS. 4 and 4(*b*), which extend axially downstream to the securing flanges 278 and engage corresponding end slots in those flanges as seen in FIG. 4(*b*).

The shroud liner segments 240 are now described with reference to FIG. 2, FIG. 2(*a*) and FIG. 6. The liner segments 240 are fixed to respective slippers 250 by means of a respective fixing pin 298. Fixing pin 298 is inserted through liner-retaining pin hole 280 of the radial slipper plate 274, a hole 300 in a flat projecting lug 302 in the centre of the upstream edge of the liner segment 240, a corresponding pin hole 300 in a corresponding lug 302 on the downstream side, and into a seating in a securing end flange 304 of the slipper 250. The lugs 302 of the liner segment 240 lie closely against the radial plate 274 and securing end flange 304 of the slipper 250. Liner segment 240 also has upstanding notched corner lugs 306 which engage the sides of the locating pieces 296 as seen in FIG. 4(*b*). Consequently the segments 240 are securely held in alignment in relation to the slippers 250.

The head of fixing pin 298 projects and fits into the guide channel 264 of body 262 on the downstream face of the NGV segment flange 258. This engagement guides a radial sense of movement between NGV segment 232 on the one hand and slipper 250 and liner segment 240 on the other hand, so as to ensure symmetrical movement of the dogs 288 in the slots 272.

The slipper and liner support system using annular support 252 is now described. Annular support 252 comprises an annular, generally radially flat plate body 308 at the downstream end, having an accurately radial machined downstream face 310 which abuts against the casing shoulder 254 (FIG. 2). From the outer periphery of the body plate 308 extends axially perpendicularly upstream a continuous cylindrical outer wall or skin 312. The upstream edge of wall 312 makes a continuous butting engagement along the outer edge 286 of each slipper plate 274, except for a small cutaway 314 (FIG. 5(*b*)) in register with the slipper notch 284.

From the inner periphery of support body 308 projects a circumferentially spaced series of integral axial fingers 316. One finger 316 is provided for each slipper element 250, and its distal end is bent up into a flange which is bolted to slipper plate 274 through support bolt-hole 282 therein, by bolt 318 (see FIGS. 2 and 2(*c*)). The extremities of fingers 316 and outer wall 312 are accurately parallel with rear body face 310 of the support 252.

The engagements of thrust cone 248 are now described. This is a continuous frustum of a general cone, fixed in relation to the outer casing 242. It has an inwardly projecting flange 320 having a notch 322 which fits over the channelled body 262 bolted to the downstream flange 258 of each NGV segment 232, to hold those segments and hence also the slipper and liner segments in circumferential alignment with it. It also has an outward flange 324 penetrated by a four-position retaining pin 326 which fits in the outer notch 284 of the slipper plate 274. This prevents undesired tilting of the movable parts in the circumference, and ensures that the circumferential relationship or alignment between NGVs and slippers is maintained after in situ machining of liner bores. The head of pin 326 fits in the cutaway 314 of the support wall 312, as seen in FIG. 5(*b*).

In operation, as the turbine accelerates to full speed, the following expansions are observed.

(1) Thermal growth of the central turbine rotor disc; this is slow and takes ten to fifteen minutes.

(2) Thermal growth of the turbine blades 230; this is very fast and takes only a few seconds.

(3) Centrifugal growth of the turbine rotor assembly; this is also very fast.

Supposing that the engine is at idle and full throttle is then selected, a rush of high temperature gas will scrub over the NGV outer platform 238 causing it and its downstream flange 258 to expand circumferentially at a very high rate.

The slipper element 250 is relatively slow to respond to the rise in temperature, partly because the cooling air around it is slower to heat than the combustion gas stream, and partly because heat transfer is lower. As a consequence, the NGV outer platform 238 expands circumferentially more than does the slipper plate 274 with which it is in engagement via the dogs and slots 288, 272. On inspection of FIG. 7, it will be clear that this relative movement in outward directions X of the driving blocks 270 will cause the dogs 288 on the slipper to travel partly up the slots 272 and hence drive the slipper radially outwardly as shown by arrow Y. This wedging effect, driving the slipper and hence also the shroud liner segments 240 outwards, occurs in the first few seconds after operating the throttle. Consequently it can accommodate the transient effect mentioned above, whereby the minimum clearance between turbine blade tip and shroud liner would otherwise occur shortly after reaching full throttle.

Subsequently, and corresponding to the steady-state condition in which the blade tip is normally slightly further clear of the shroud liner, the slipper itself continues its thermal expansion to a steady state. At this stage it expands relative to the NGV platform 238, which has already reached its steady state. Consequently, the wedging action works in reverse and the slipper and liner segment 240 return to a more radially inward condition to reduce the tip clearance to a smaller value.

The circumferential growth of these components is governed by the temperature rise and their coefficients of thermal expansion. The radial effect can however be varied to some extent by changing the angle of the inclined or wedging surfaces Finally, the effect of the annular support 252 is described.

It is very important that the slippers 250 and hence the liner segments do not tilt to any significant degree as conditions vary during operation. However it is also essential that the load from behind the shroud liner due to cooling air pressure is sufficient to overcome any support friction, so that the slipper is always loaded onto the inclined driving surfaces of the NGV platform and will follow their movement.

The driving forces act at one axial end of the slipper, while the cooling air pressure acts all along it. Consequently a couple arises tending to tilt the liner segment 240. The support of the slipper must resist this couple.

If the radial flange of the slipper were for example fitted into a locating slot, the necessary counter-couple could be created by respective compressive forces at the mouth of the slot of the flange and at the end of the flange in the slot. Tilting could be prevented, but it could not be guaranteed that the friction due to these engagements would be small enough to allow proper operation of the radial adjustment.

In the present construction, the slipper element is supported from one side by the bolted connection to the finger 316, and by the abutting or compressive engagement against the end surface of the outer wall 312 of the support 252. When a couple tends to tilt the liner and slipper assembly, this can be countered by a couple arising from tension in the finger 316 and compression of the outer support wall 312. Furthermore, the finger 316 can take up any radial displacement of the slipper in operation by slight flexion; no frictional sliding is required except at the outer, compressive engagement. Consequently friction is kept down to a level where positive radial adjustment can be assured.

Because the shroud liner segment 240 is supported by the slipper from one side only, it becomes easier to assemble or disassemble the turbine. In particular, the slipper and shroud liner can be assembled as a module together with the NGV segment 232 and perhaps also the thrust cone 248, and the shroud liner then machined in situ. By this means a number of dimensional and concentricity tolerances in the various parts of the module can be ignored and manufacture greatly simplified.

We claim:

1. In a gas turbine engine having a main casing, turbine blades and a segmented cylindrical liner located radially of and surrounding the tips of the blades, an apparatus for compensating for differing radial expansions between the blades and the liner, the apparatus comprising a shroud structure axially adjacent the liner and including radially extending coupling means for coupling the liner to said structure in such a manner that thermal circumferential growth of said shroud structure causes a radial displacement of the liner segment relative to said adjacent shroud structure.

2. An apparatus as claimed in claim 1 wherein the axially adjacent shroud structure is provided by an outer platform of a nozzle guide vane.

3. An apparatus as claimed in claim 1 wherein the coupling means is provided by a slipper element positioned radially outwardly of said shroud structure and adapted to expand circumferentially in operation more slowly than said shroud structure.

4. An apparatus as claimed in claim 3 wherein a difference in circumferential thermal expansion rate between two parts being the slipper element and said shroud structure is converted to a relative radial displacement by means of a slipping interface between said parts along which the engaging portion of one of the parts can ride when differential circumferential expansion occurs, and which is inclined to the tangential direction.

5. An apparatus as claimed in claim 4 wherein the slipping interface is provided by one or more dogs on one part with inclined slipping surfaces engaging complementary inclined surfaces of recesses on the other part.

6. An apparatus as claimed in claim 5 wherein each liner segment is provided with a respective said slipper element, the slipper element being substantially separate from the liner segment but fixed thereto in a manner which permits the liner segment to expand freely in a circumferential direction without conflicting with the expansion of the slipper.

7. An apparatus as claimed in claim 4 wherein the slipper element has a generally L-section comprising a radially outwardly extending limb by which it can be supported in the main casing, and which may carry the slipping interface to engage the shroud structure, and an axially extending limb with means for securing the liner segments.

8. An apparatus as claimed in claim 1 wherein each radially movable liner segment is supported through a radially extending carrier part integral therewith or secured thereto, there being provided a main support to engage the carrier part from one axial side thereof at radially spaced locations so as to be able to support a couple, the main support engaging the carrier part with a first, compression-bearing engagement of a first engagement location, and of a second engagement location with a second, tension-bearing part of the main support which is radially flexible so that it can deflect at the second engagement location to follow the radial displacement of the liner segment relative to the main support.

9. An apparatus as claimed in claim 8 wherein the compression-bearing part of the support makes sliding engagement against the carrier part at the first locations.

10. An apparatus as claimed in claim 8 wherein the main support has an annular construction extending around the turbine so as to support all of the set of movable liner segments.

11. An apparatus as claimed in claim 8 wherein the carrier part is provided by a radial flange, being the slipper element, at or towards one axial extremity of the liner segment.

12. An apparatus as claimed in claim 11 wherein the carrier part is on the upstream side of the liner segment, and the main support engages the carrier part for the downstream side.

13. An apparatus as claimed in claim 8 wherein the tensile part of the main support comprising an axially-extending flexible finger extending from a body portion of the main support, and adapted to be fixed at its free end to the carrier.

14. An apparatus as claimed in claim 8 wherein the compression part of the support is a continuous wall extending axially and abutting against the carrier.

15. An apparatus as claimed in claim 8 wherein the main support is an annulus with a rectangular cross-section, the outer side of the rectangle being the cylindrical wall for compressive engagement, the inner side being provided intermittently by tensile flexible fingers, one axial end being open and against the carrier, and the other end being parallel to the surface of the carrier part and forming a body to connect the inner and outer parts solidly together.

* * * * *